US007641320B2

(12) United States Patent
Sagara et al.

(10) Patent No.: US 7,641,320 B2
(45) Date of Patent: Jan. 5, 2010

(54) INK JET HEAD AND METHOD OF MANUFACTURE THEREOF

(75) Inventors: Tomoyuki Sagara, Nara (JP); Yoshinori Nakajima, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 499 days.

(21) Appl. No.: 11/662,832

(22) PCT Filed: Sep. 14, 2005

(86) PCT No.: PCT/JP2005/016887

§ 371 (c)(1),
(2), (4) Date: Mar. 13, 2007

(87) PCT Pub. No.: WO2006/030801

PCT Pub. Date: Mar. 23, 2006

(65) Prior Publication Data

US 2007/0263039 A1 Nov. 15, 2007

(30) Foreign Application Priority Data

Sep. 14, 2004 (JP) ..... 2004-267545

(51) Int. Cl.
*B41J 2/045* (2006.01)

(52) U.S. Cl. ..... 347/68

(58) Field of Classification Search ..... 347/68, 347/69–72; 310/367; 400/124.16, 124.17
See application file for complete search history.

(56) References Cited

U.S. PATENT DOCUMENTS 7,073,893 B2 * 7/2006 Takeuchi et al. ..... 347/68
7,367,658 B2 * 5/2008 Kusunoki et al. ..... 347/68

FOREIGN PATENT DOCUMENTS

JP 10-235907 9/1998
JP 2001-199065 7/2001
JP 2001-347662 12/2001

* cited by examiner

*Primary Examiner*—K. Feggins
(74) *Attorney, Agent, or Firm*—David G. Conlin; Steven M. Jensen; Edwards Angell Palmer & Dodge LLP

(57) ABSTRACT

An ink jet head has a plurality of first ink chambers (3) front end portions of which open at an end surface (A) of the substrate and rear end portions of which are blocked, and a plurality of second ink chambers (4) front end portions of which open at an end surface (B) on the opposite side to the end surface (A) and rear end portions of which are blocked. Furthermore, this ink jet head has electrodes formed upon inner walls of the first ink chambers (3) and the second ink chambers (4), a first common ink chamber (6) formed between the rear end portions of the second ink chambers (4) and the end surface (A) and communicated with the first ink chambers (3), and a second common ink chamber (7) formed between the rear end portions of the first ink chambers (3) and the end surface (B) and communicated with the second ink chambers (4). And this ink jet head has a nozzle plate covering the first ink chambers (3) and the second ink chambers (4), and having nozzle holes formed to correspond to those ink chambers.

8 Claims, 12 Drawing Sheets

CROSS SECTION ALONG LINE AA - AA

CROSS SECTION ALONG LINE BB - BB

INK JET HEAD AND METHOD OF MANUFACTURE THEREOF

TECHNICAL FIELD

The present invention relates to a head construction for an ink jet printer.

BACKGROUND ART

An ink jet printer prints a picture upon a medium such as paper or the like by discharging minute liquid drops of ink from minute nozzle holes provided in an ink jet head, according to printing data. Some such printer devices using such an ink jet method are capable of making full color pictures with an ink jet head which is charged with inks of the four colors cyan, magenta, yellow, and black, or with inks of six colors by adding to those light cyan and light magenta.

Recently it has also become widespread, by installing such an ink jet head to a production device, to perform manufacture of wiring patterns and color filters and the like, and to apply such processes in industry.

FIG. 10 is a perspective view of a prior art ink jet head. FIG. 11 is a perspective view of a portion thereof cut along the line CC-CC in FIG. 10. And FIG. 12 is a perspective view showing the fitting state of a prior art multi color ink jet head to a head holding member.

A number of grooving processes are performed by dicing upon a piezoelectric substrate 101 which has been polarized in its thickness direction, and thereby ink chambers 104 are formed. Electrodes 105 are formed upon the inner walls of these ink chambers 104, and electrode protective layers (not shown in the drawings) of thickness of about 10 μm are formed so as to cover over these electrodes 105. Electrically conductive material not shown in the figures is loaded into the rear end portions of the electrodes 104. A common ink chamber 103 is formed in a cover member 102. This common ink chamber 103 is communicated with all the ink chambers upon the piezoelectric substrate 101, and thereby it is arranged to supply ink from this common ink chamber 103 to the various ink chambers 104. The ink jet head 100 consists of the piezoelectric substrate 101 with the cover member 102 adhered thereto.

In the structure described above, when voltages corresponding to the printing data are applied to the electrodes 105, the wall portions of these ink chambers 104 are deformed, and the ink within the ink chambers 104 is pressurized. As a result, this ink is discharged from nozzle holes, not shown in the figures, which are provided in front end portions of the ink chambers 104.

With this type of piezoelectric method, since it is possible to control the amount of pressurization of he ink and the volumes of the discharged ink drops by regulating the voltage, thus controlling the deformation of the piezoelectric elements, accordingly the distinguishing feature is that tone printing is available in a simple manner.

It is possible to perform color printing by providing a plurality of ink jet heads 100 of the structure described above in combination, and by outputting inks of different colors from the various heads. FIG. 12 shows an ink jet head 200 in which four ink jet heads 100 are disposed upon a head holding member 106, and which is capable of such color printing.

However, since these individual ink jet heads 100 are separate members, it is necessary to assemble these separate members to the head holding member 106, and it is not guaranteed that the positions of the various nozzle holes are determined at high accuracy, so that the problem has arisen of the yield factor being low.

Thus, in order to solve this problem, the construction disclosed in Patent Document #1 has been proposed.

That is, by forming an ink chamber of a different length for each of the ink colors, and by supplying inks of the various colors from ink supply conduits corresponding to these ink chambers of different lengths which are formed in a top plate, it becomes possible, by processing a single piezoelectric substrate, to manufacture an ink jet head which provides multi color printing in yellow, magenta, cyan, and black. According to this structure the beneficial effect is obtained that it is possible to enhance the quality of the printing, since it is possible to perform determination of the positions of the various nozzle holes at high accuracy without it being necessary to give any consideration to positional deviation between the different heads; and, moreover, the yield factor during mass production is enhanced.

Patent Document #1: JP H10-235907A

DISCLOSURE OF THE INVENTION

Problems to be Solved by the Invention

However, in the case of the ink jet head described above, since the ink chambers for the inks of the various colors are made to be of different lengths, accordingly it becomes necessary to provide dummy ink chambers of the same lengths adjacent to the various ink chambers, in order to make the conditions of ink discharge from the various ink chambers be the same. Because of this, to the extent that these dummy ink chambers are provided, it becomes difficult to make the pitch of the discharge nozzles smaller. Moreover, although the ink conduits which are formed in the top plate open in the sides of the head, and the common ink chambers for each of the colors are formed in these portions, nevertheless, in order to ensure the flow amounts of the inks and in order to reduce the resistance of the flow conduits, along with increase of the number of the ink chambers, it also becomes necessary to increase the areas of the apertures; and furthermore it is necessary to increase the pitch of those common ink chambers in order to eliminate color mixing and leakage. Supposing that the width of the common ink chambers is 2 mm and the pitch of these common ink chambers is 3 mm, then a length of 11 mm is required for four colors, and moreover, when the width of the electrode pattern at the rear end portion of the head and the groove length is added, the head length becomes greater than 20 mm, which is undesirable. Since, in this manner, with the ink jet head of the above described structure, it is difficult to reduce the pitch of the discharge nozzles, and moreover it is necessary to make the pitch of the common ink chambers great, accordingly it only becomes possible to obtain a few heads from a single wafer, and there has been a limit to making the heads themselves more compact.

Furthermore, since the lengths of the ink chambers for the inks of the various colors are different, accordingly, in order to perform uniform driving for each color, it is necessary to control the drive voltages and the drive pulse widths appropriately for the length and depth of each of the ink chambers, and there has been the problem that the control for performing this task becomes complicated.

The object of the present invention is to provide an ink jet head which implements increase of density and also improvement of accuracy.

Means for Solving Problem

The present invention includes:

a plurality of first ink chambers formed upon a piezoelectric substrate, front end portions of which open at a first end surface of said substrate, and rear end portions of which are blocked;

a plurality of second ink chambers formed upon said piezoelectric substrate, front end portions of which open at a second end surface which is opposite to said first end surface, and rear end portions of which are blocked;

electrodes formed upon inner walls of said first ink chambers and said second ink chambers;

a first common ink chamber formed upon said piezoelectric substrate between said rear end portions of said second ink chambers and said first end surface, and communicated with said first ink chambers;

a second common ink chamber formed upon said piezoelectric substrate between said rear end portions of said first ink chambers and said second end surface, and communicated with said second ink chambers; and a nozzle plate covering said first ink chambers and said second ink chambers, and having nozzle holes formed to correspond to those ink chambers.

With the present invention, the respective opening portions of the first ink chambers and the second ink chambers are positioned at opposite surfaces of the piezoelectric substrate, and the first common ink chamber is formed upon the piezoelectric substrate so as not to intersect the second ink chambers, while the second common ink chamber is formed upon the piezoelectric substrate so as not to intersect the first ink chambers. Due to this, these ink chambers can be set to be of the same length, and moreover it is also not necessary to provide any dummy ink chambers. Furthermore, it is possible to discharge inks of two colors by varying the color of the ink for the first ink chambers and the color of the ink for the second ink chambers.

The first common ink chamber supplies ink to all of the first ink chambers, and the second common ink chamber supplies ink to all of the second ink chambers. Because of this, from the standpoint of reducing flow conduit resistance, the groove widths of the common ink chambers, desirably, are at least greater than the groove widths of the ink chambers, and, more desirably, are dimensionally widened as much as possible.

In a preferred embodiment of the present invention, the first common ink chamber is formed between the rear end portions of the second ink chambers and the first end surface. Due to this, the first common ink chamber and the second ink chambers do not intersect. In the same manner, since the second common ink chamber is formed between the rear end portions of the first ink chambers and the second end surface, the second common ink chamber and the first ink chambers do not intersect.

In a preferred embodiment of the present invention, said plurality of first ink chambers and said plurality of second ink chambers are arranged alternatingly adjacent to one another. Furthermore, the depths of the opening portions of said plurality of first ink chambers and said plurality of second ink chambers are formed to be shallower than the depths of their other portions, and said electrodes which are formed upon the inner walls of these opening portions constitute external connection terminals.

With the structure described above, inks of different colors can be discharged from the odd numbered nozzles and the even numbered nozzles. Furthermore, since there are no dummy ink chambers, it is possible to narrow down the pitch of the ink chambers. Moreover, since the depths of the opening portions of the ink chambers are shallower, terminal connection at these portions becomes simple. By widening the ink chamber widths at the opening portions which become the external connection terminals during processing, it is also possible to enhance the connection reliability at these portions.

And, in a preferred embodiment of the present invention, ink is supplied to the first common ink chamber from a third end portion of the piezoelectric substrate, and ink is supplied to the second common ink chamber from a fourth end surface on the opposite side from said third end surface. Furthermore, the ink jet head main body is stored in a recessed portion formed in a base portion, and ink supply apertures are provided which communicate with ink sump spaces formed on the side of said third end surface and on the side of said fourth end surface. Accordingly, supply of ink to the ink jet head main body from externally is performed via these ink supply apertures.

Effects of the Invention

According to the present invention, it is possible to discharge inks of a plurality of different colors while making the pitch of the ink chambers short, without any necessity for providing dummy ink chambers, and moreover by processing a single piezoelectric substrate.

EXPLANATION OF REFERENCE NUMBERS

1—piezoelectric substrate
2—ink jet head
3—first ink chamber
4—second ink chamber
5—electrode
6—first common ink chamber
7—second common ink chamber

BEST MODE FOR CARRYING OUT THE INVENTION

An embodiment of the present invention will now be explained with reference to FIGS. 1 through 8.

Figure 1:
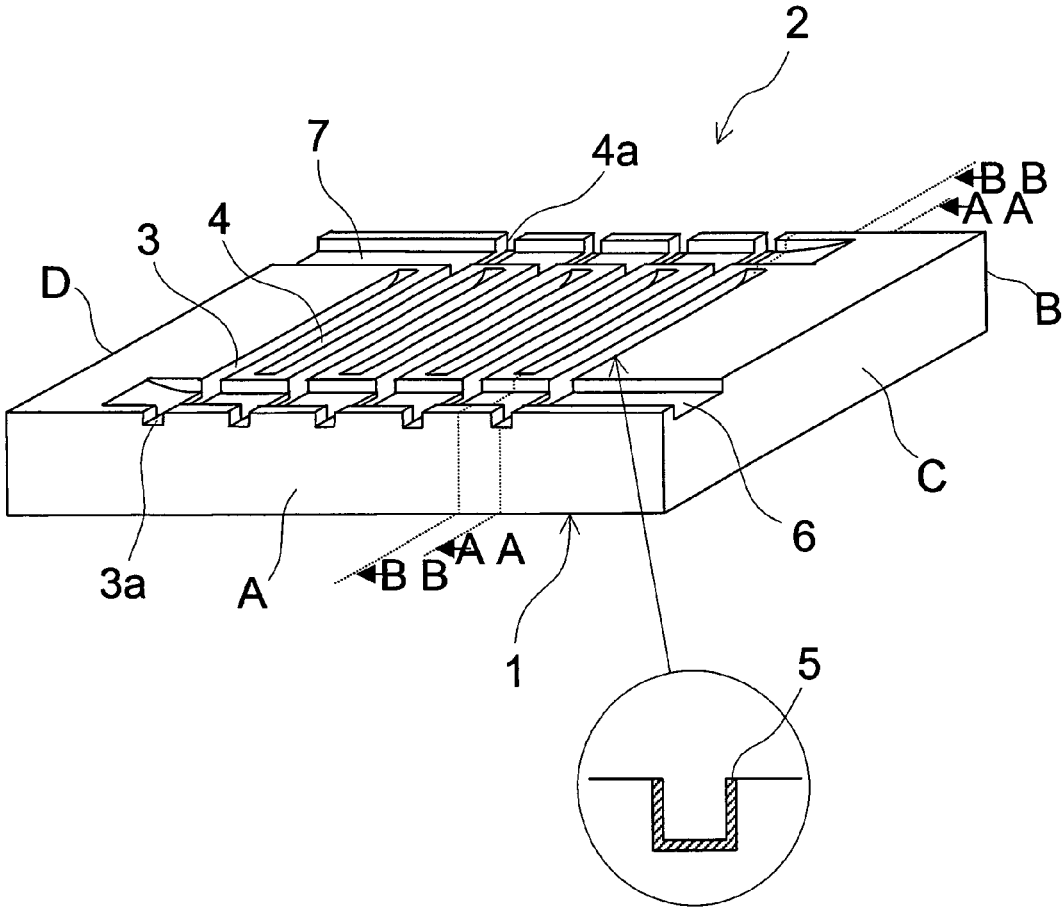
FIG. 1 is a perspective view of an ink jet head which is an embodiment of the present invention.

FIG. 1 is a perspective view of an ink jet head which is an embodiment of the present invention.

Figure 2:
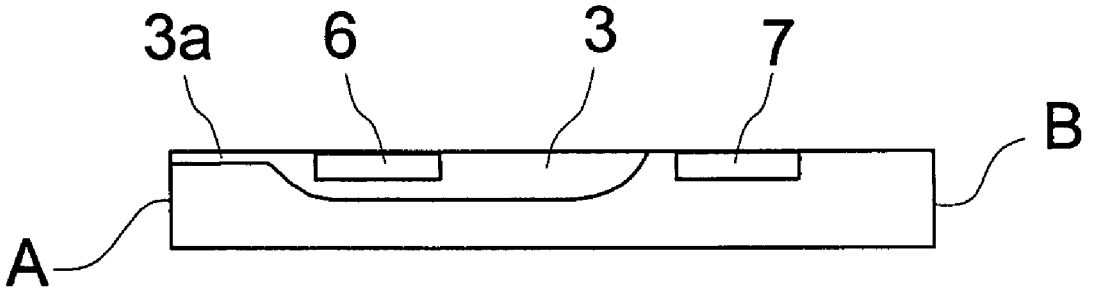
FIG. 2 is a figure showing cross sections of FIG. 1 along dotted lines AA-AA and BB-BB.
Figure 2:
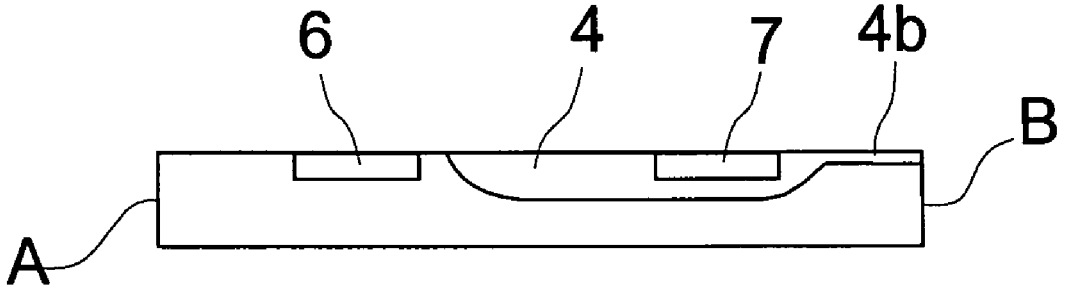
Figure 3:
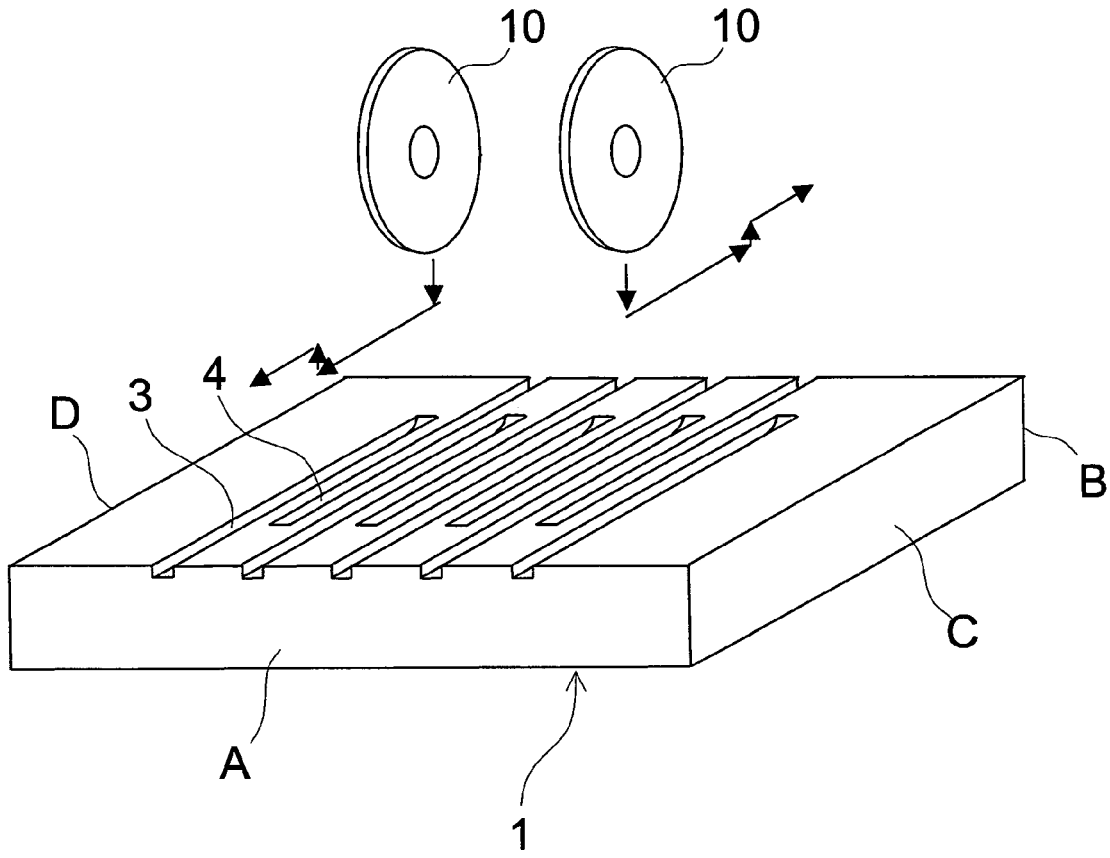
FIG. 3 is a figure showing a step in the processing of this ink jet head.

FIG. 2 is a figure showing cross sections of FIG. 1 along the dotted lines AA-AA and BB-BB.

The piezoelectric substrate 1, which is of a rectangular shape, is obtained by cutting a single wafer with a dicing device. Actually, the processing of the piezoelectric substrate 1 is performed upon the wafer, and a plurality of ink jet heads 2 are formed simultaneously by cutting after this processing. In the following, the construction of a single one of these ink jet heads 2 will be explained.

Upon the piezoelectric substrate 1, there are formed a plurality of first ink chambers 3, whose front end portions open upon a first end surface A of the substrate 1 and whose rear end portions are blocked, and a plurality of second ink chambers 4, whose front end portions open upon a second end surface B which is opposite to the first end surface A and whose rear end portions are blocked. These first ink chambers 3 and second ink chambers 4 are provided alternatingly adjacent to one another, and all of these ink chambers are provided as parallel.

Furthermore, electrodes 5 are formed upon the inner walls of the first ink chambers 3 and the second ink chambers 4. These electrodes 5 are used for applying pulse voltages to the inner walls of the ink chambers, thus expanding and contracting the ink chambers and thereby discharging ink.

A first common ink chamber 6 is formed upon the piezoelectric substrate 1 between the rear end portions of the second ink chambers 4 and the first end surface A. This first common ink chamber 6 is communicated with the first ink chambers 3, and intersects the first ink chambers 3 at right angles. The depth of this first common ink chamber 6 is set to be shallower than the depth of the first ink chambers 3. In the same manner, a second common ink chamber 7 is formed upon the piezoelectric substrate 1 between the rear end portions of the first ink chambers 3 and the second end surface B. This second common ink chamber 7 is communicated with the second ink chambers 4, and intersects the second ink chambers 4 at right angles. The depth of this first common ink chamber 6 is set to be shallower than the depth of the first ink chambers 3 [sic].

As shown in FIG. 2, the depth of opening portions 3*a* of the first ink chambers 3 and the depth of opening portions 4*a* of the second ink chambers 4*a* are formed to be shallower than the depths of their other portions. A nozzle plate which will be described hereinafter, and which constitutes an external connection terminal which connects said electrodes formed upon the inner walls of these opening portions 3*a*, 4*a* to an external drive unit (not shown in the drawings), covers the first ink chambers 3 and the second ink chambers 4, and is provided with nozzle holes which are formed so as to correspond to those ink chambers.

By providing the above structure, ink of a first color is supplied from the first common ink chamber 6, and is conducted to the first ink chambers 3. When, in this state, a pulse voltage is applied to the opening portion 3*a* of any one or more of the first ink chambers, which is its external connection terminal, so that this ink chamber is excited, then the ink in this ink chamber is discharged from a nozzle hole of the nozzle plate. Accordingly, ink of the first color comes to be discharged in the upwards direction in FIG. 1.

Furthermore, ink of a second color is supplied from the second common ink chamber 7, and is conducted to the second ink chambers 4. When, in this state, a pulse voltage is applied to the opening portion 4*a* of any one or more of the second ink chambers, so that this ink chamber is excited, then the ink in this ink chamber is discharged from a nozzle hole of the nozzle plate. Accordingly, ink of the second color also comes to be discharged in the upwards direction in FIG. 1. In this manner, it is possible to discharge ink of the first color and ink of the second color simultaneously in the upward direction.

As will be clear from FIG. 1, in this embodiment, no dummy ink chambers are necessary. Accordingly, the pitch of the ink chambers which are excited, in other words the pitch of the nozzle holes which are provided so as to correspond to these ink chambers, becomes equal to the gap between the first ink chambers 3 and the second ink chambers 4, so that it is possible to manufacture an ink jet head which has pitch of high density.

Next, the processing work for the ink jet head described above will be explained with reference to FIG. 3.

A piezoelectric substrate 1 is made by gluing together two piezoelectric substrates whose directions of polarization are different and whose thicknesses are 0.15 mm and 0.9 mm, so that the thickness thereof is 1.05 mm.

The ink chambers are processed upon the piezoelectric substrate 1 by using a blade 10 of a dicing machine from above the substrate. At this time, for the ink chambers 3, the processing is performed while shifting the blade 10 in the direction of the end surface A of the piezoelectric substrate 1, so that their front end portions are opened at that end surface A while their rear end portions remain blocked. And, for the ink chambers 4, the processing is performed while shifting the blade 10 in the direction of the end surface B of the piezoelectric substrate 1, so that their front end portions are opened at that end surface B while their rear end portions remain blocked. And the ink chambers 3 and the ink chambers 4 are processed so as to alternate in position (i.e. so as to be adjacent). By doing this, the ink chambers 3 which open in the end surface A and the ink chambers 4 which open in the end surface B are arranged so as to alternatingly adjacent to one another.

Furthermore, as shown in FIG. 2, the opening portions 3*a*, 4*a* of the ink chambers are processed so as to have shallower depths.

By forming external connection terminals upon the end surface A and the end surface B in this manner, it is possible to increase the reliability for connection, since it is possible to increase the external connection terminal pitch upon each one of the end surfaces.

It should be understood that, by widening the widths of the opening portions 3*a*, 4*a* of the ink chambers which constitute the external connection terminals, it is also possible further to enhance the connection reliability at these portions.

Next, the electrodes 5 are formed upon the inner walls of these ink chambers 3, 4 by vapor deposition, spattering, a plating method, or the like. In this process, the electrodes 5 are also formed upon the surface of the piezoelectric substrate 1, except for the ink chambers 3 and the ink chambers 4. Since, in this state, the ink chambers 3, 4 are in a short circuited state, accordingly, after forming the electrodes 5, using the dicing machine, grinding processing is performed upon the surface of the piezoelectric substrate 1 to a depth of only 50μ, so that the electrodes 5 are eliminated upon the surface of the piezoelectric substrate 1 and its thickness is reduced to 1.0 mm. By this processing, a state is reached in which the electrodes 5 are only formed upon the inner walls of the ink chambers 3 and the ink chambers 4.

By performing the grinding processing described above, it is possible to bring the degree of parallelism between the rear surface of the piezoelectric substrate 1 and its front surface to approximately 3 μm.

Figure 4:
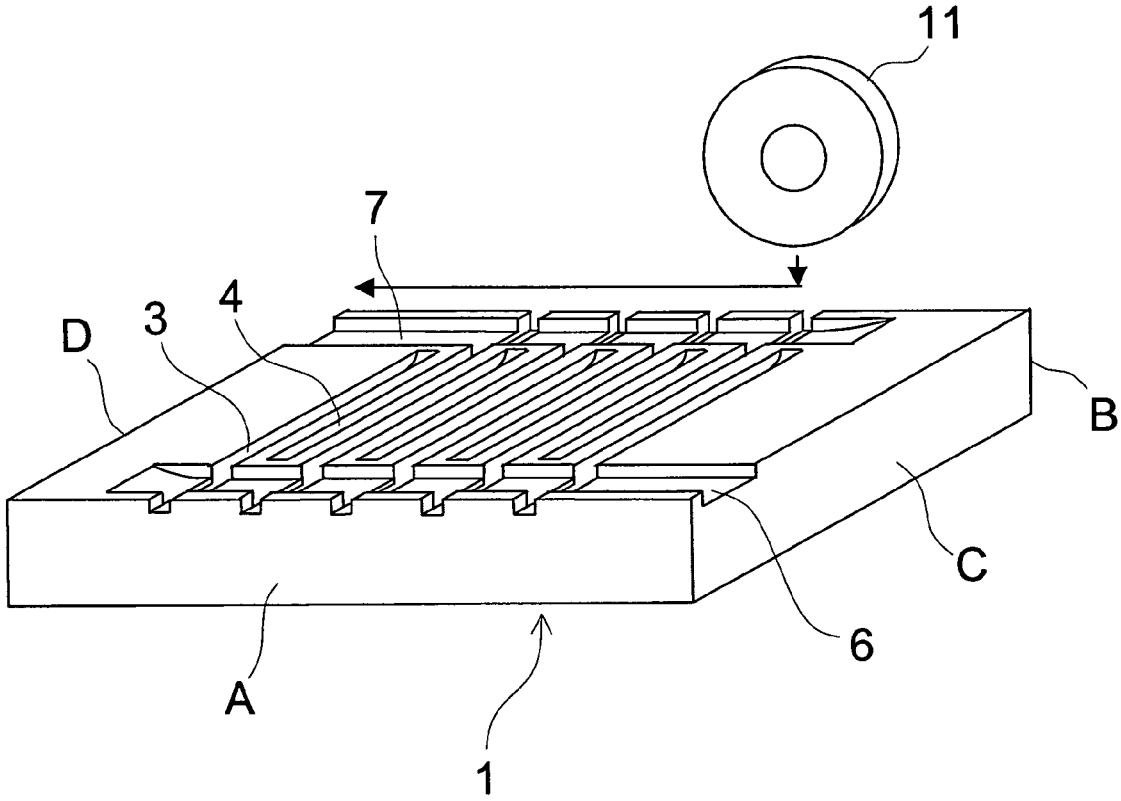
FIG. 4 is another figure showing a step in the processing of this ink jet head.

Next, as shown in FIG. 4, the common ink chambers 6, 7 are processed using the blade of the dicing machine. The common ink chambers 6, 7 are processed so as to be orthogonal to the ink chambers 3, 4. Furthermore, the common ink chamber 6 is processed so as to be positioned at the end surface A, and so as to be positioned between the rear end portions of the second ink chambers 4 and the end surface A, while the common ink chamber 7 is processed so as to be positioned at the end surface B, and so as to be positioned between the rear end portions of the first ink chambers 3 and the end surface B.

The common ink chambers 6, 7 are processed so as to be shallower than the ink chambers 3, 4, and thereby it is possible to ensure continuity between the electrodes 5 which are formed upon the inner walls of the ink chambers 3, 4 and the electrodes of the opening portions 3*a*, 4*a* which constitute the external connection terminals.

Since the common ink chamber 6 supplies ink to all of the ink chambers 3, and the common ink chamber 7 supplies ink to all of the ink chambers 4, from the standpoint of making the resistance of the flow conduits low, the groove widths of these common ink chambers 6, 7 are processed to be as wide as possible.

With the above structure, it becomes possible to manufacture, upon a single piezoelectric substrate, an ink jet head which is capable of discharging inks of two colors.

The processing described previously is performed in the wafer state, and is capable of being performed in a state in which a large number of sections for formation of ink jet heads 2 are laid out upon the piezoelectric substrate 1.

From this wafer state, the plurality of ink jet heads 2 are separated by cutting the wafer into its various sections with the dicing machine. The positional accuracy of the cutting by the dicing machine at this time is around 2~3 μm.

Next, a method for implementation of this ink jet head 2 will be explained using FIGS. 5 through 8.

Figure 5:
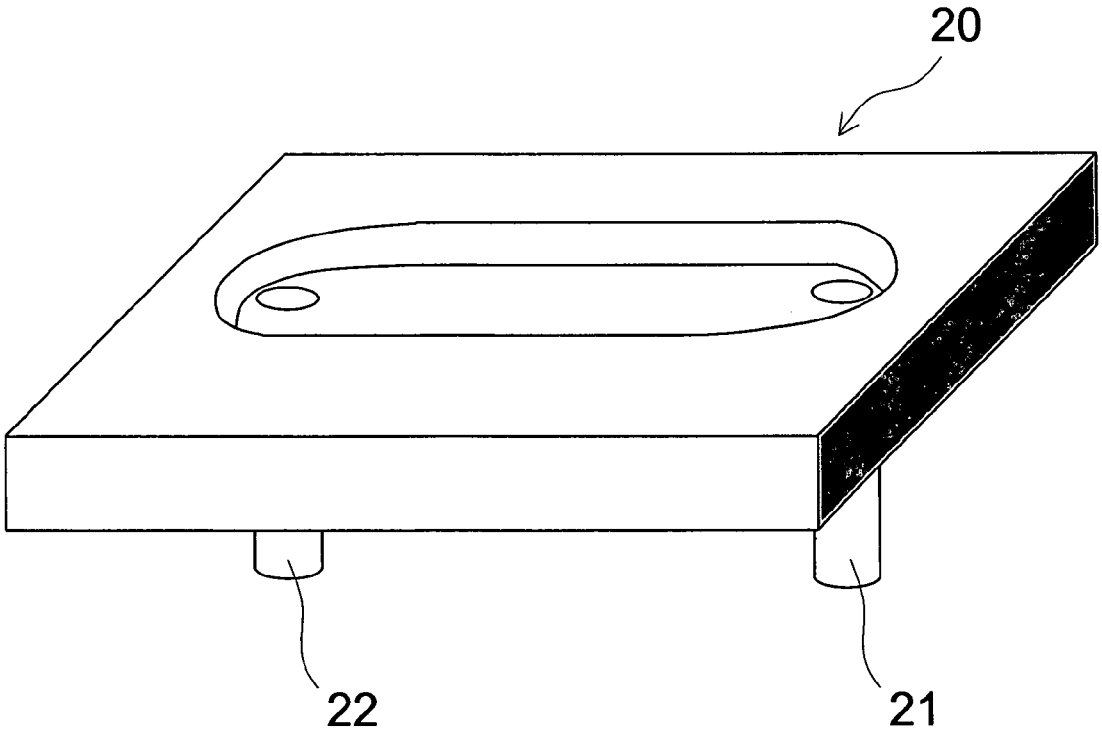
FIG. 5 is a figure showing the structure of a base.

FIG. 5 shows a base 20 upon which the ink jet head 2 is mounted. This base 20 is formed by recess processing a plate of thickness 3 mm made from aluminum, stainless steel, ceramic, or the like to a depth of just 0.95 mm, by performing aperture processing at both of the end portions which have been recess processed, and by connecting ink supply pipes 21, 22 to these aperture portions. Furthermore, the length of the recessed portion is set to be longer than the length of the ink jet head 2.

By taking the rear surface of this base 20 as a reference, the degree of parallelism of the recess processed portion can be processed to an accuracy less than or equal to 5 μm.

Figure 6:
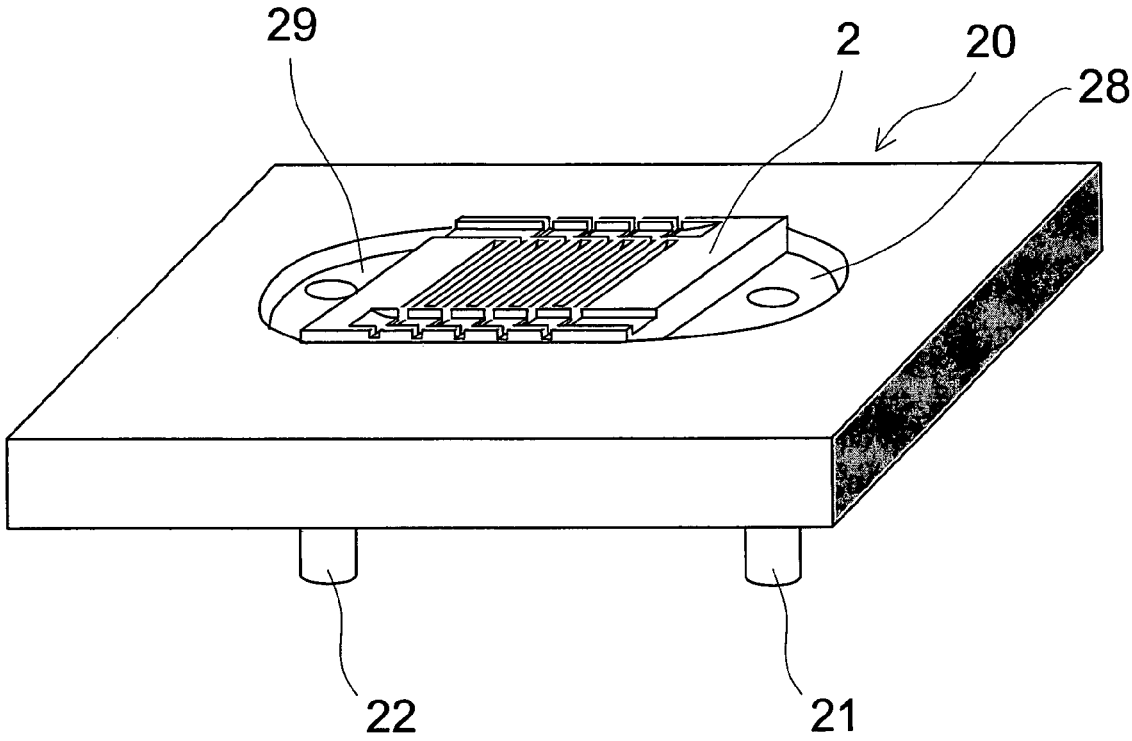
FIG. 6 is a figure showing a state in which the ink jet head is housed in a recessed portion of the base.

Next, as shown in FIG. 6, the ink jet head 2 is positioned (housed) in this recessed portion of the base 20, and is adhered therein. The depth of recessing is set to such a depth that, when the ink jet head 2 is thus housed, its upper portion projects above the recessed portion by 50 μm. Furthermore, since the length of the recessed portion is set to be longer than the length of the ink jet head 2, accordingly ink sump spaces 28, 29 are formed at the two end portions of the recessed portion. After having housed the ink jet head 2 in the recessed portion, adhesive is flowed between the recessed portion and the ink jet head 2, so that the gap between them is sealed.

Figure 7:
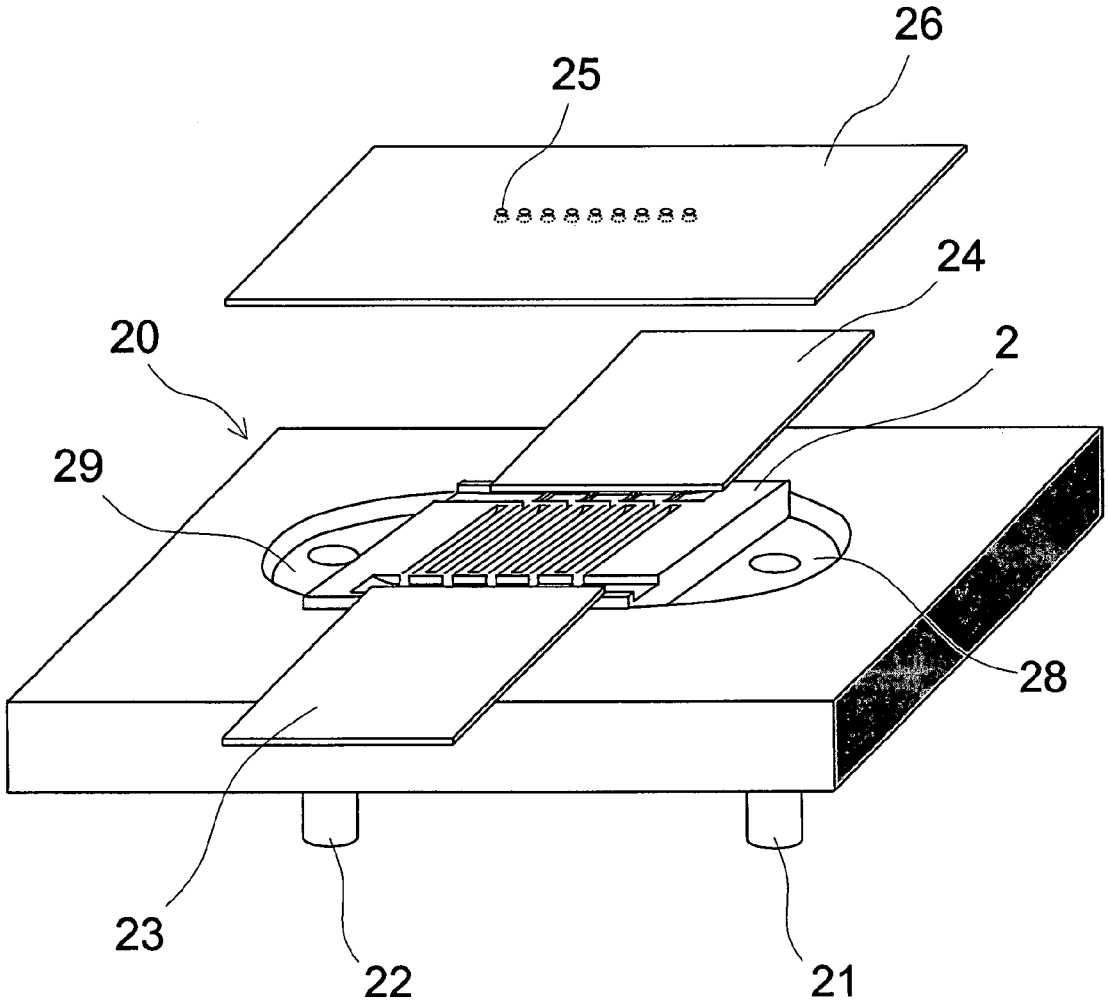
FIG. 7 is a figure showing the assembly of this ink jet head unit.

Next, as shown in FIG. 7, respective flexible wiring substrates 23, 24 are connected with anisotropic electrically conductive resin (not shown in the drawings) to the opening portions 3*a*, which are external connection terminals of the electrodes 5 opened in the end surface A of the ink jet head 2, and to the opening portions 4*a*, which are external connection terminals thereof opened in the end surface B. By doing this, it becomes possible to drive the electrodes 5 of the ink jet head 2 from the exterior. With regard to the method of connection, apart from this method of connection with anisotropic electrically conductive resin, a method of connecting leads of the flexible wiring substrates 23, 24 directly to the external connection terminals, or a method of connection by wire bonding, or the like, may also be contemplated.

Furthermore, since the connection portions of the flexible wiring substrates 23, 24 to the external connection terminals have thickness about 50 μm, accordingly, by setting the recessed depth of the recessed portion to a depth at which, when the ink jet head 2 is housed in the recessed portion, its upper portion projects 50 μm above the recessed portion, when the flexible wiring substrates 23, 24 are connected to said external connection terminals, it is possible to bring about a state in which there is no difference in level between the surfaces of the ink jet head 2 and the flexible wiring substrates 23, 24.

Next, with the objective of protecting the electrodes 5 which have been formed upon the inner walls of the ink chambers 3, 4 of the ink jet head 2 from the ink, an electrode protective layer (not shown in the drawings) of thickness about 10 μm is formed. Since this electrode protective layer would adhere to portions other than the ink chambers 3, 4, accordingly, during the layer formation process, masking tape or the like is adhered to the flexible wiring substrates 23, 24 etc. which are the main portions to which the electrode protective layer is not to be adhered, so that they are masked off. Although it would also be acceptable to perform the layer formation process for this electrode protective layer before connecting the flexible wiring substrates 23, 24, in this case, it would be necessary to mask off the external connection terminals with masking tape or the like.

Next the nozzle plate 26, which has been processed with the nozzle holes 25, is mated to the surface of the ink jet head 2.

The nozzle holes 25 are opened at positions which correspond to the ink chambers 3, 4 of the ink jet head 2, and the external size of the nozzle plate 26 is set to be larger than the external size of the ink jet head 2. Adhesive is transferred to the surface of the ink jet head 2, and, while monitoring with a camera for detecting the position of the ink chambers 3, 4 of the ink jet head and the position of the nozzle holes 25 of the nozzle plate 26, the nozzle plate 26 is attached while position compensation is performed.

After having adhered the nozzle plate 26 to the ink jet head 2, adhesive is flowed into the gap portion between the nozzle plate 26 and the base 20, and thereby the inside of the nozzle plate 26 is sealed.

At this time, the adhesive is also flowed into the gaps between the flexible wiring substrates 23, 24 and the base 20, and the gaps between the nozzle plate 26 and the flexible wiring substrates 23, 24, so that the inside is sealed.

Figure 8:
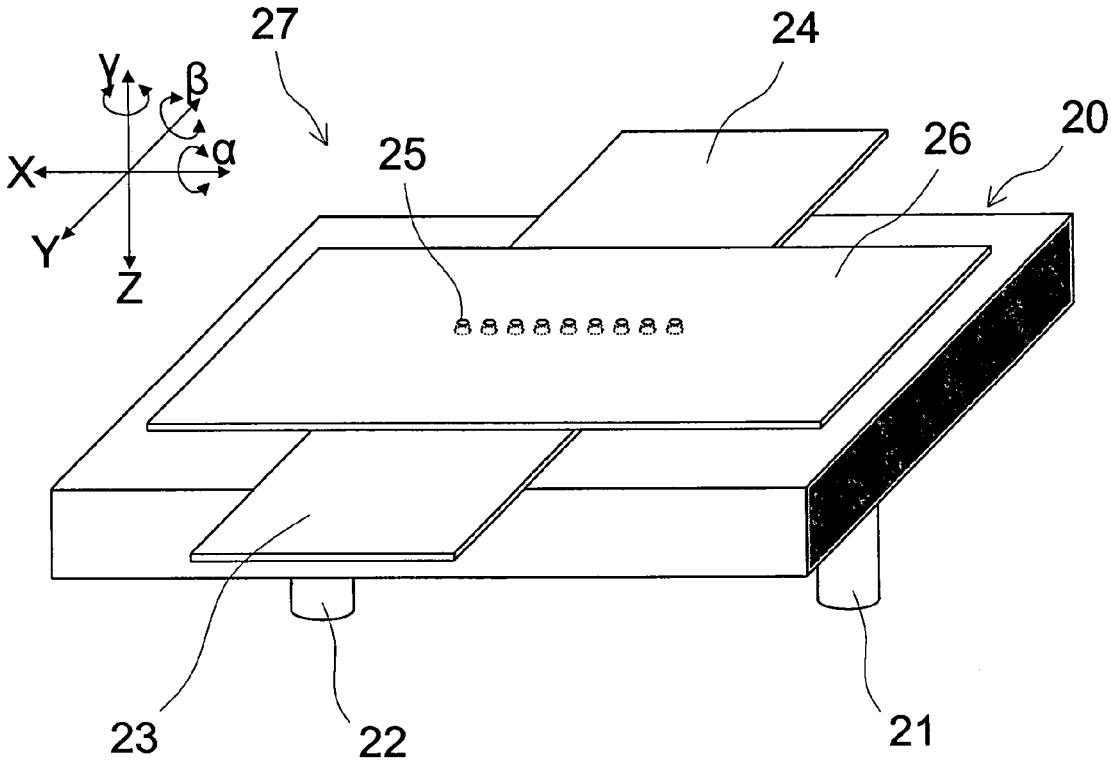
FIG. 8 is another figure showing the assembly of this ink jet head unit.

By the above processing, it is possible to manufacture the ink jet head unit 27 as shown in FIG. 8.

The ink which is supplied from the ink supply pipe 21 of this ink jet head unit 27 flows from the ink sump space 28 of the recessed portion of the base 20 through the common ink chamber 6 of the ink jet head 2 into the ink chambers 3, and is discharged from the nozzle holes 25 which are formed in the nozzle plate 26 by the electrodes 5 of the ink chambers being driven by pulse voltages via the flexible wiring substrate 23. Moreover, the ink which is supplied from the ink supply pipe 22 of the ink jet head unit 27 flows from the ink sump space 29 of the recessed portion of the base 20 through the common ink chamber 7 of the ink jet head 2 into the ink chambers 4, and is discharged from the nozzle holes 25 which are formed in the nozzle plate 26 by the electrodes 5 of the ink chambers being driven by pulse voltages via the flexible wiring substrate 24.

This discharge of ink is directed to the surface on the side where groove processing of the piezoelectric substrate 1 is performed.

By making the discharge of ink be on the side where groove processing of the piezoelectric substrate 1 is performed, it is possible to form the external connection terminals on both the end surface A and also the end surface B, and, furthermore, as compared with a prior art structure in which the external connection terminals were formed upon one end surface only, the pitch of the external connection terminals can have twice the clearance. Due to this, a high connection reliability is obtained.

By supplying ink of different colors to the pipes 21, 22, it becomes possible to discharge ink of different colors from the odd numbered ones and from the even numbered ones of the nozzle holes 23 which are formed in the nozzle plate 24.

In the above described processing processes, by performing a grinding process as described above, it is possible to ensure that the degree of parallelism between the front surface of the piezoelectric substrate 1 and its rear surface is about 3 μm. Due to this, by taking the rear surface of the piezoelectric substrate 1 as a reference when implementing this ink jet head 2, it is possible to regulate the variation upon the Z axis in FIG. 8, α (rotation around the X axis as a center), and β (rotation around the Y axis as a center); and it is accordingly possible to ensure that the degree of parallelism of the nozzle surface is around 3 μm.

Furthermore, since it is possible to obtain a positional accuracy of cutting of the ink jet head 2 with the dicing machine of 2~3 μm, accordingly, by taking the rear surface of the piezoelectric substrate 1 as a first reference, and the cutting portion of the ink jet head 2 by the dicing machine as a second reference, it is possible to regulate the variation upon the X axis, the variation upon the Y axis, and γ (the rotation around the Z axis as a center).

Figure 9:
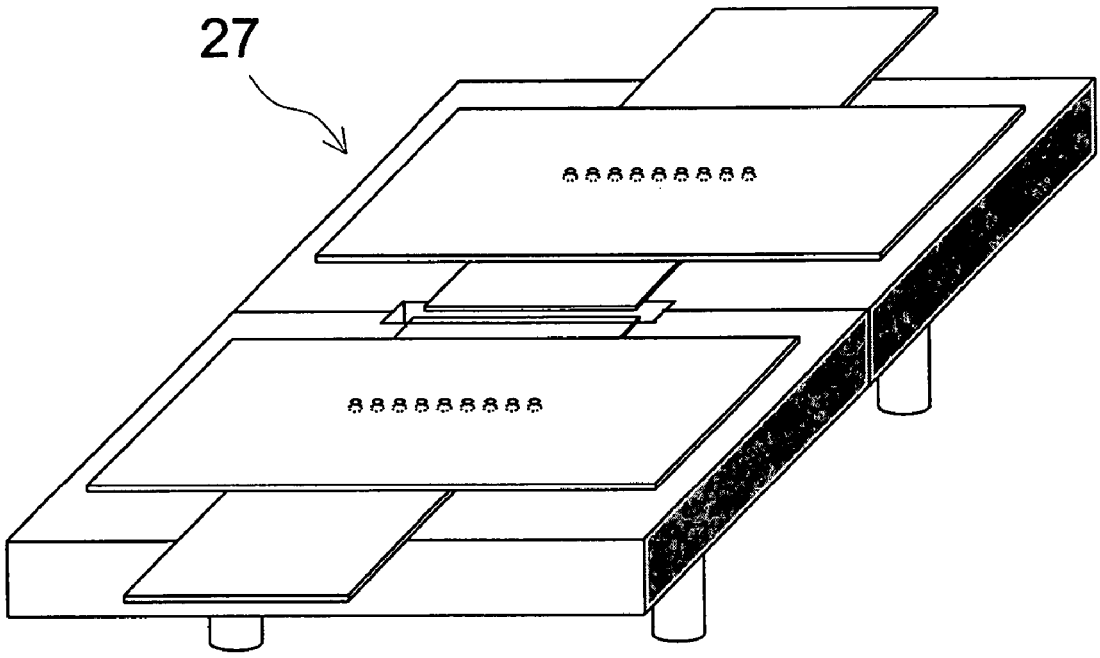
FIG. 9 is a final figure showing this multi color ink jet head unit.
Figure 10:
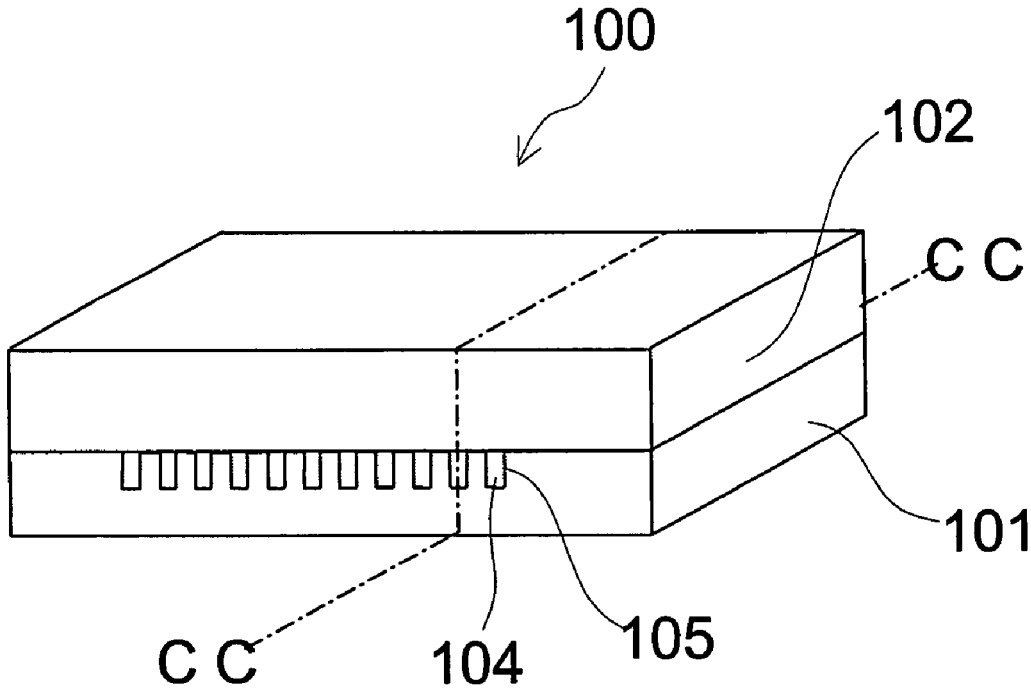
FIG. 10 is a perspective view of a prior art ink jet head.
Figure 11:
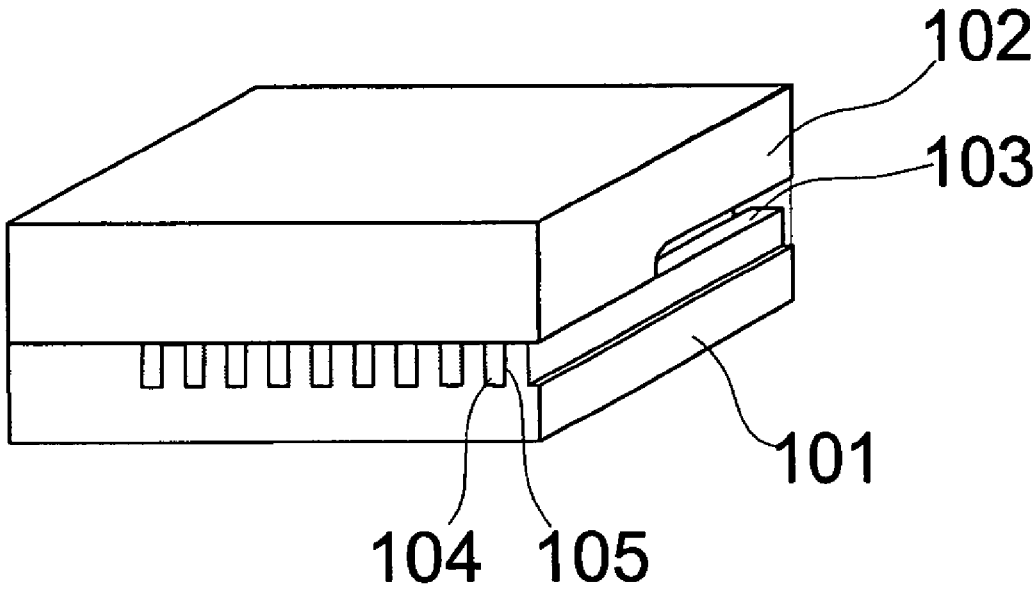
FIG. 11 is a perspective view of a portion thereof cut along the line CC-CC in FIG. 10.
Figure 12:
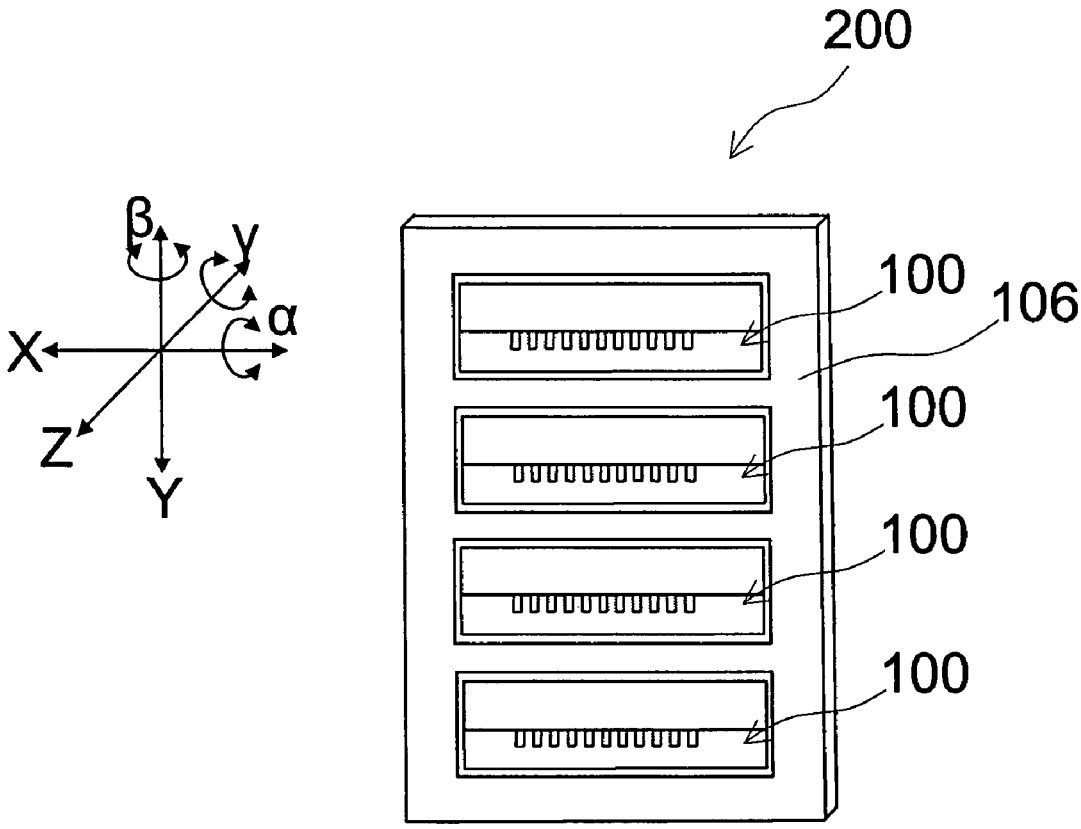
FIG. 12 is a perspective view showing the fitting state of a prior art multi color ink jet head to a head holding member.

Accordingly, by taking the rear surface of the piezoelectric substrate 1 as a first reference, and the cutting portion by the dicing machine as a second reference, it is possible to adjust the mutual positions of a plurality of the ink jet heads 2 at high accuracy, so that it is possible to incorporate them into a multi color ink jet head unit. In other words, by taking the rear surfaces of the various ink jet heads 2 as first references, it is possible to regulate their variation upon the Z axis, α (rotation around the X axis as a center), and β (rotation around the Y axis as a center). Furthermore, by taking the cutting portions by the dicing machine where the cutting surfaces of adjacent ones of the ink jet heads 2 are mutually contacted together as second references, it is possible to regulate the variation upon the X axis, the variation upon the Y axis, and γ (the rotation around the Z axis as a center) of these heads. Due to this type of facts, it is possible to implement a multi color combination of a plurality of ink jet heads in an extremely simple manner, and it is possible to maintain the level of position accuracy at high accuracy. FIG. 9 shows an example in which a four color multi color ink jet head unit 27 is built up by combining two of the ink jet heads 2 with this type of method.

As described above, according to this embodiment of the present invention, by processing a single piezoelectric substrate, while raising the pitch density of the ink chambers, it is possible to discharge inks of a plurality of different colors.

The invention claimed is:

1. An ink jet head, comprising:

a plurality of first ink chambers formed upon a piezoelectric substrate, front end portions of which open at a first end surface of said substrate, and rear end portions of which are blocked;

a plurality of second ink chambers formed upon said piezoelectric substrate, front end portions of which open at a second end surface which is opposite to said first end surface, and rear end portions of which are blocked;

electrodes formed upon inner walls of said first ink chambers and said second ink chambers;

a first common ink chamber formed upon said piezoelectric substrate between said rear end portions of said second ink chambers and said first end surface, and communicated with said first ink chambers;

a second common ink chamber formed upon said piezoelectric substrate between said rear end portions of said first ink chambers and said second end surface, and communicated with said second ink chambers; and a nozzle plate covering said first ink chambers and said second ink chambers, and having nozzle holes formed to correspond to those ink chambers.

2. An ink jet head as described in claim 1, wherein said plurality of first ink chambers and said plurality of second ink chambers are arranged alternatingly adjacent to one another.

3. An ink jet head as described in claim 2, wherein the depths of the opening portions of said plurality of first ink chambers and said plurality of second ink chambers are formed to be shallower than the depths of their other portions, and said electrodes which are formed upon the inner walls of these opening portions constitute external connection terminals.

4. An ink jet head as described in claim 3, wherein:

a front end portion of said first common ink chamber opens at a third end surface which is orthogonal to said first end surface and a rear end portion thereof is blocked, and said first common ink chamber receives supply of ink from said third end surface; and a front end portion of said second common ink chamber opens at a fourth end surface on the opposite side to said third end surface and a rear end portion thereof is blocked, and said second common ink chamber receives supply of ink from said fourth end surface.

5. An ink jet head as described in claim 4, further comprising a base portion which supports an ink jet head main body; and wherein said base portion comprises:

a recessed portion which is of a size to store said ink jet head main body, and which defines ink sump spaces on the side of said third end surface and on the side of said fourth end surface; and ink supply apertures formed in said recessed portion, which supply ink to said ink sump spaces from the exterior.

6. An ink jet head as described in claim 5, wherein said nozzle plate is set to a size to cover said recessed portion.

7. A method of manufacturing ink jet heads, comprising:

a process of laying out a plurality of sections for forming ink jet heads upon a single wafer made from a piezoelectric material;

for each section:

a process of forming a plurality of first ink chambers, front end portions of which open at a first end surface of said section and rear end portions of which are blocked;

a process of forming a plurality of second ink chambers, front end portions of which open at a second end surface opposite to said first end surface and rear end portions of which are blocked;

a process of forming electrodes upon inner walls of said first ink chambers and said second ink chambers;

a process of forming a first common ink chamber between said rear end portions of said second ink chambers and said first end surface, communicated with said first ink chambers;

a process of forming a second common ink chamber between said rear end portions of said first ink chambers and said second end surface, communicated with said second ink chambers; and a process of covering upper portions of said first ink chambers and said second ink chambers with a nozzle plate which has nozzle holes formed to correspond to those ink chambers; and a process of, after said processes are completed, obtaining a plurality of ink jet heads by cutting apart these sections with a dicing machine.

8. A method of manufacturing ink jet heads as described in claim 7, further comprising a process of forming a single ink jet head unit by aligning the cut surfaces of a predetermined number of the heads for said ink jet head, while performing positional alignment by taking the bottom surfaces of these heads as a first reference, and the cut surfaces of these heads as a second reference.

* * * * *